US010136728B2

(12) United States Patent
Ben-Haim

(10) Patent No.: US 10,136,728 B2
(45) Date of Patent: Nov. 27, 2018

(54) ADJUSTABLE FURNITURE

(71) Applicant: Niv Ben-Haim, Richmond Hill (CA)

(72) Inventor: Niv Ben-Haim, Richmond Hill (CA)

( * ) Notice: Subject to any disclaimer, the term of this patent is extended or adjusted under 35 U.S.C. 154(b) by 67 days.

(21) Appl. No.: 15/533,150

(22) PCT Filed: Mar. 29, 2017

(86) PCT No.: PCT/US2017/024868
§ 371 (c)(1),
(2) Date: Jun. 5, 2017

(87) PCT Pub. No.: WO2017/189149
PCT Pub. Date: Nov. 2, 2017

(65) Prior Publication Data

US 2018/0255929 A1 Sep. 13, 2018

Related U.S. Application Data

(60) Provisional application No. 62/327,974, filed on Apr. 26, 2016.

(51) Int. Cl.

| | |
|---|---|
| ***A47C 4/34*** | (2006.01) |
| ***A47C 1/026*** | (2006.01) |
| ***A47C 1/14*** | (2006.01) |
| ***A47C 1/023*** | (2006.01) |
| *A47C 1/025* | (2006.01) |

(52) U.S. Cl.
CPC ..... *A47C 1/026* (2013.01); *A47C 1/023* (2013.01); *A47C 1/143* (2013.01); *A47C 1/025* (2013.01); *A47C 1/14* (2013.01)

(58) Field of Classification Search
CPC ..... A47C 1/14; A47C 1/143; A47C 1/024; A47C 1/026; A47C 20/026; A47C 20/043; Y10S 297/90; B60N 2/02
See application file for complete search history.

(56) References Cited

U.S. PATENT DOCUMENTS

| | | | | |
|---|---|---|---|---|
| 2,783,824 A * | 3/1957 | Rechler | A47C 1/026 297/360 |
| 3,774,247 A * | 11/1973 | Bradley | A47C 19/022 5/53.2 |
| 4,392,685 A | 7/1983 | Leonhart | |
| 5,244,249 A | 9/1993 | Tseng | |
| 6,062,648 A | 5/2000 | Adler | |
| 6,102,479 A * | 8/2000 | Wallace | A47C 1/143 16/235 |

(Continued)

FOREIGN PATENT DOCUMENTS

CN 202775159 U 3/2013

*Primary Examiner* — Shin H Kim
(74) *Attorney, Agent, or Firm* — Shalom Wertsberger; Saltamar Innovations

(57) ABSTRACT

A chair having an adjustable backrest and control actuator disposed forward of the backrest hinge, for controlling the backrest angle. The chair has a backrest support hinged to the backrest away from the backrest/chair hinge, and coupled directly or indirectly to track runners which run along elongated support tracks. A positioner is controlled by the control actuator and coupled to the backrest support and track runners, limiting the extent to which the track runners may move along the support tracks and thus control the angle of the backrest.

18 Claims, 20 Drawing Sheets

(56) References Cited

U.S. PATENT DOCUMENTS

| | | | | |
|---|---|---|---|---|
| 6,213,555 | B1 * | 4/2001 | Sulpizio | A47C 1/143 108/116 |
| 6,588,836 | B1 | 7/2003 | Lo | |
| 6,860,567 | B1 | 3/2005 | Bauer | |
| 7,025,421 | B1 * | 4/2006 | Fowler | A47C 1/026 297/325 |
| 7,147,277 | B1 * | 12/2006 | Miller | A47C 1/0265 297/19 |
| 7,207,622 | B2 | 4/2007 | Cohan et al. | |
| D657,150 | S | 4/2012 | Hughes et al. | |
| D668,071 | S | 10/2012 | Pedersen et al. | |
| 8,585,135 | B2 | 11/2013 | Wilson | |
| D707,049 | S | 6/2014 | Asner | |
| 9,173,492 | B1 | 11/2015 | Fortin | |
| 9,185,982 | B2 | 11/2015 | Kilzer | |
| 2006/0071522 | A1 * | 4/2006 | Bedford | A47C 1/023 297/300.2 |
| 2006/0225201 | A1 * | 10/2006 | Kristen | A47C 1/0352 5/12.1 |
| 2009/0127909 | A1 * | 5/2009 | Caldwell | A47C 1/143 297/354.12 |
| 2011/0193372 | A1 * | 8/2011 | Pizzuto | A47C 1/143 297/16.1 |
| 2016/0120323 | A1 * | 5/2016 | Rivera | A47C 7/66 297/184.15 |
| 2016/0338491 | A1 * | 11/2016 | Demichael | A47C 11/00 |
| 2018/0249836 | A1 * | 9/2018 | Wise | A47C 1/143 |

* cited by examiner

ADJUSTABLE FURNITURE

FIELD OF THE INVENTION

The invention relates generally to seating apparatuses like chairs, chaise lounges, deck chairs and the like, and more particularly to such seating apparatuses having an adjustable back.

BACKGROUND OF THE INVENTION

Chairs, chaise lounges, reclining chairs, lawn chairs, convertible beds, convertible chairs, sun chairs, and deck chairs are but some of the common synonyms of a type of a seating apparatus having legs or a base which supports a horizontal seat section, and a backrest section. For brevity the term 'chair' will be used for any such seating apparatus. Oftentimes the chair further includes a leg-rest portion which may be integral to the chair or separated therefrom. The leg-rest may also be adjustably rotatable relative to the seat so a user may select the most comfortable position. Certain seats may include further features such as armrests, trays, and the like. Certain chairs of that type may also be foldable for easy transportation.

Many chairs have adjustable backrests to allow the user to recline to a comfortable position. Angle of the backrest is controlled by a reclining mechanism allowing the user to establish a preferred angle between the seat and the backrest. Different reclining mechanisms are known but most require the user to get off the chair, adjust the backrest, and get back onto the chair. In some chairs, complex mechanisms, such as motors or transmissions are utilized. Such arrangements are often less desirable as they add cost and weight.

There is therefore a long-felt need for a lightweight, inexpensive, and jam resistant reclining mechanism for a chair which does not require the person sitting on the chair to get up to adjust the chair backrest angle.

SUMMARY OF THE INVENTION

An object of the present invention is to provide a chair with a backrest reclining mechanism, where a user may adjust the backrest position from a control actuator which is located at a convenient location such as under the seat portion of the chair. Doing so will enable the user to adjust the backrest angle without having to get up from the chair. Furthermore, it is an object of the present invention to provide the backrest reclining mechanism which is cost effective and reliable.

To that end in its most general embodiment, the invention provides a backrest supported by a backrest support which can change its position along support tracks. A control actuator is located forward of the pivot point of the backrest relative to the seat. A positioner controlled by the control actuator limits the extent of which the backrest support may travel backwards along the support track and thus limits the angle formed between the seat and backrest.

Therefore, in an aspect of the invention, there is provided an adjustable chair comprising a pair of substantially parallel support frames disposed at a distance between the support frames having a rear portion, mid-portion, and a front portion. A seat is disposed between the support frames; the chair optionally has a leg support. A backrest is pivotable relative to the seat, the backrest is disposed rearward to the seat and may be pivoted at least partially over the rear portion. A control actuator is disposed about the mid portion of the front portion, or at least forward of the point at which the backrest hinges relative to the seat. At least one longitudinally extending support track is coupled to the seat and disposed at least partially about the rear portion. At least one track runner may slide over the support track, the track runners being directly or indirectly coupled to a backrest support having an upper portion hingedly coupled to the backrest. A positioner having an engagement end coupled to the at least one track runner, and a longitudinally opposing control end is also provided, the control end being coupled to the control actuator, such that the engagement end is constructed to limit the extent of rearward movement of at least one track runner about the support track.

The control actuator may in some embodiments comprise a horizontally extending slot, and a plurality of notches dimensioned to receive a portion of the control end of the positioner. In other embodiments it may utilize a gear and pinion mechanism, and in some embodiments which use the belt or strap type positioner, the control actuator may comprise a rotating body such as a shaft or a roller, and a strap or a belt spooled thereabout. In such embodiments, a rotator is coupled to the spool for controllable rotation thereof. The rotator may be a shaft, a knob, a gear, and the like, and may be the rotating body itself or a portion thereof. Most such embodiments also comprise a handle coupled to the rotator and disposed forward of the hinge point of the backrest, and a stop selectable for selectively stopping the rotator from rotating. The stop may be a physical brake or a part moved into engagement with other portions of the chair such as a hole, a frame edged, and the like. In certain embodiments the control actuator may comprise gears, friction mechanisms, screws, pinions, chains, belts, and the like.

In some embodiments the positioner comprises at least one rigid longitudinal member. In other embodiments the positioner comprises a longitudinally extending strap, coupling between the control end and the engagement end.

In an embodiment of the invention there is provided an adjustable chair comprising:

a pair of substantially parallel support frames disposed at a distance between the support frames having a rear portion, mid-portion, and a front portion;

a seat disposed between the support frames;

a backrest pivotable relative to the seat, the backrest being disposed rearward to the seat and at least partially over the rear portion;

a control actuator disposed about the mid portion or the front portion;

each of the support frames having a longitudinally extending support track disposed at least partially about the rear portion;

at least two track runners each sliding over a respective support track;

a backrest support having an upper portion hingedly coupled to the backrest, and a lower portion, each side of the lower portion being coupled to the respective one of at least two track runners;

a positioner having an engagement end coupled to the track runners, and a longitudinally opposing control end, the control end being coupled to the control actuator, such that the engagement end is constructed to limit the extent of rearward movement of the track runner about the support track.

SHORT DESCRIPTION OF DRAWINGS

The summary above, and the following detailed description will be better understood in view of the enclosed drawings which depict details of preferred embodiments. It should however be noted that the invention is not limited to the precise arrangement shown in the drawings and that the drawings are provided merely as examples.

Figure 4A:
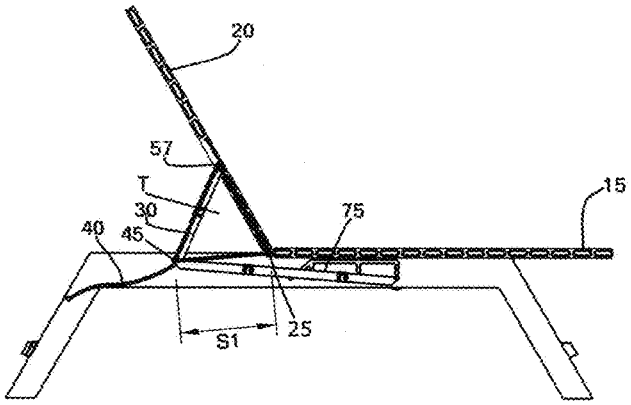
Figure 4B:
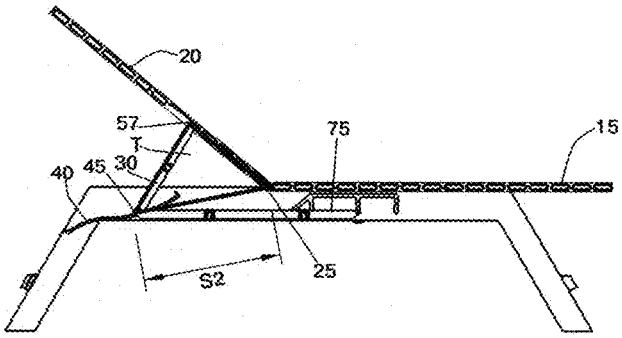
Figure 4C:
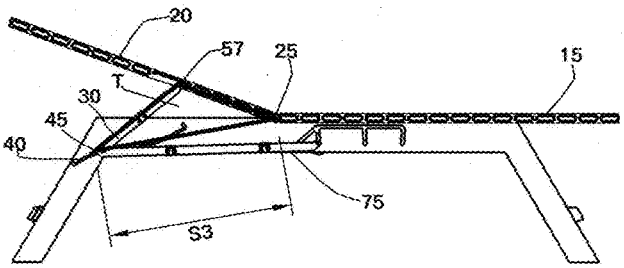

FIGS. 4A-C depict schematically operation of an embodiment of the adjustment mechanism.

Figure 5:
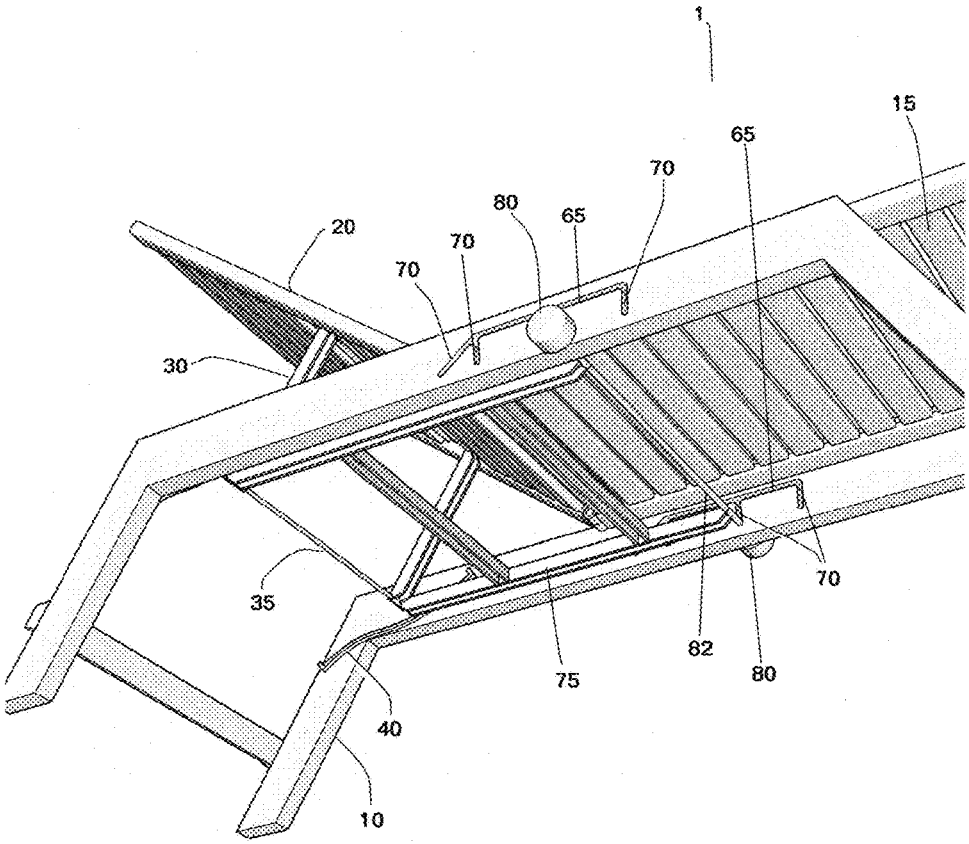

FIG. 5 depicts a partial bottom perspective view of the chair, showing an adjustment mechanism embodiment.

Figure 6:
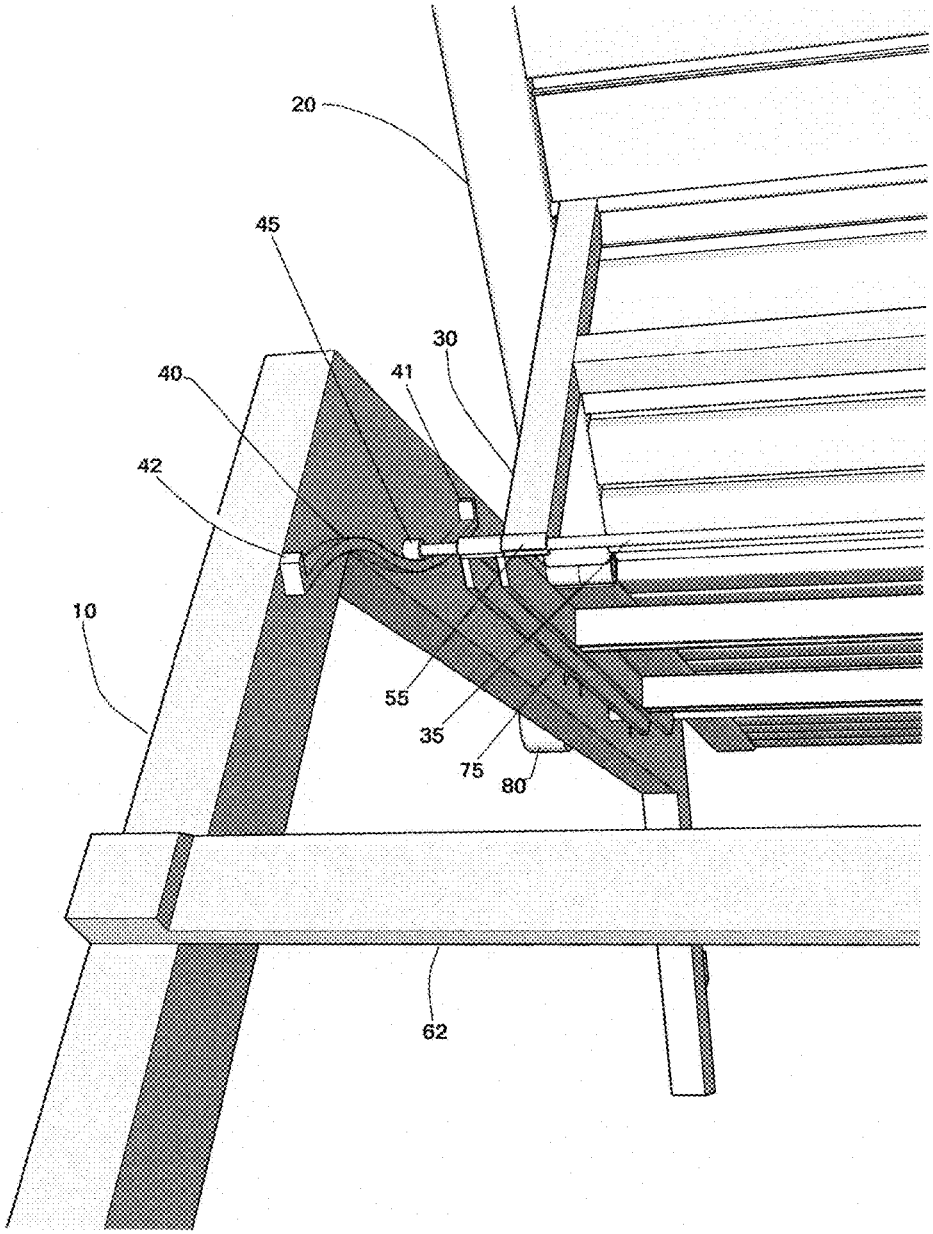

FIG. 6 depicts close-up of a rear portion of the chair, showing a support track and a track runner, coupled to the backrest, backrest support, and a positioner.

FIG. 7A-E depicts an expanded view of an embodiment of a chair.

Figure 8A:
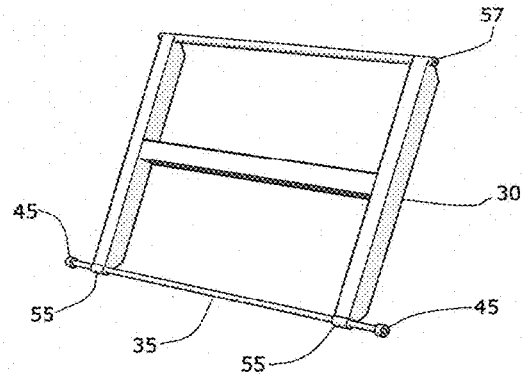
Figure 8B:
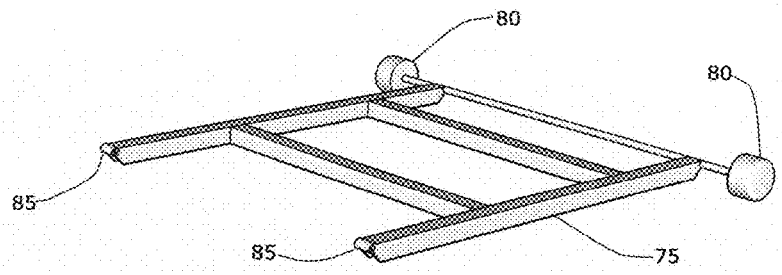
Figure 8C:
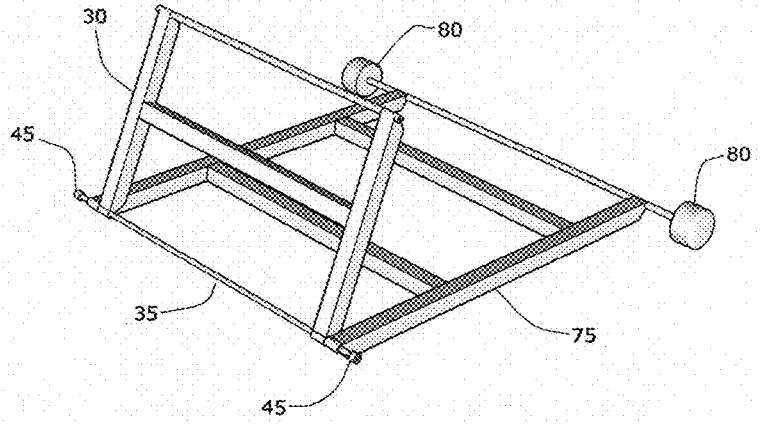

FIGS. 8A-C depict one embodiments of the backrest support and positioner

Figure 9A:
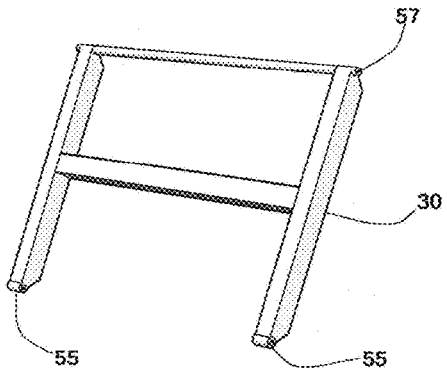
Figure 9B:
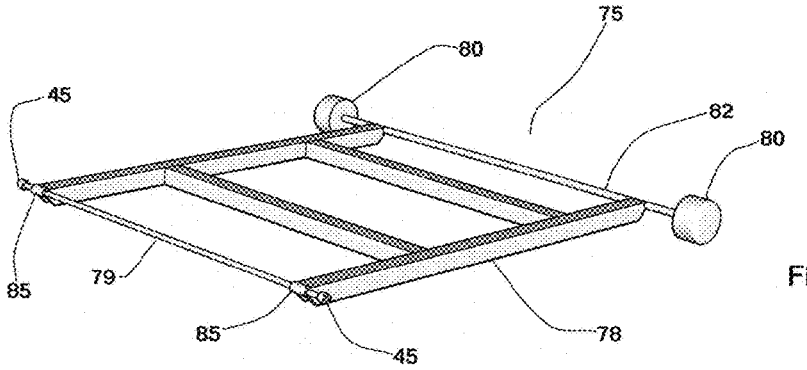
Figure 9C:
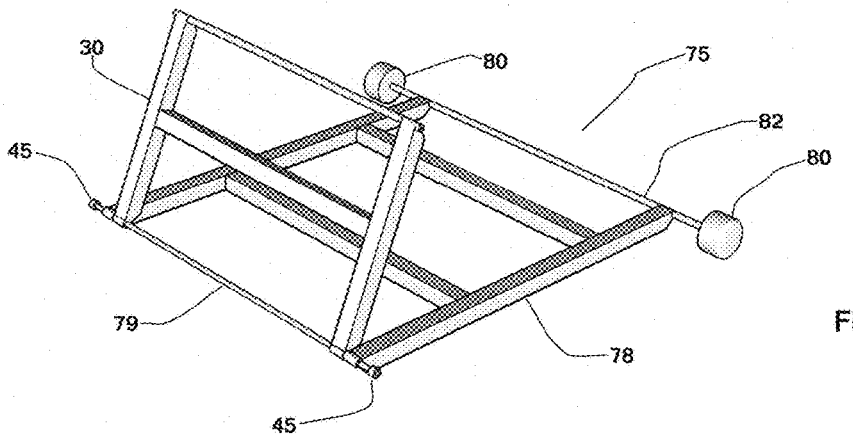

FIGS. 9A-C depict a another embodiment of a positioner and backrest support.

Figure 10:
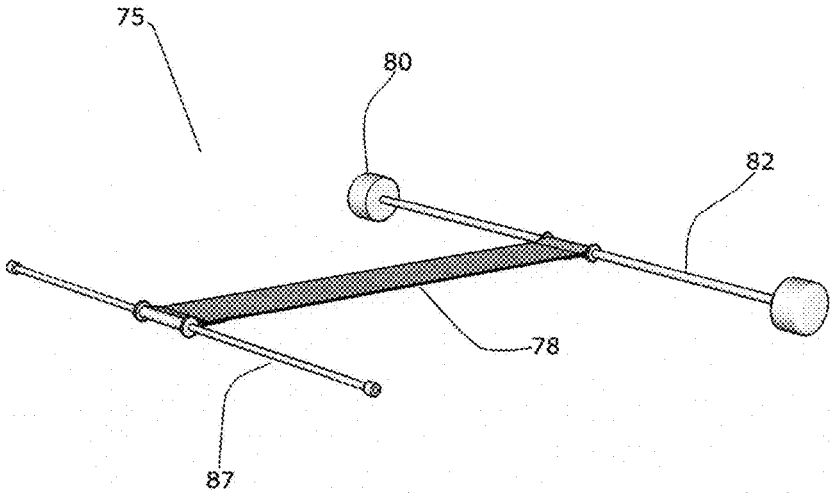

FIG. 10 depicts yet another alternative embodiment of a positioner, using a strap.

Figure 10A:
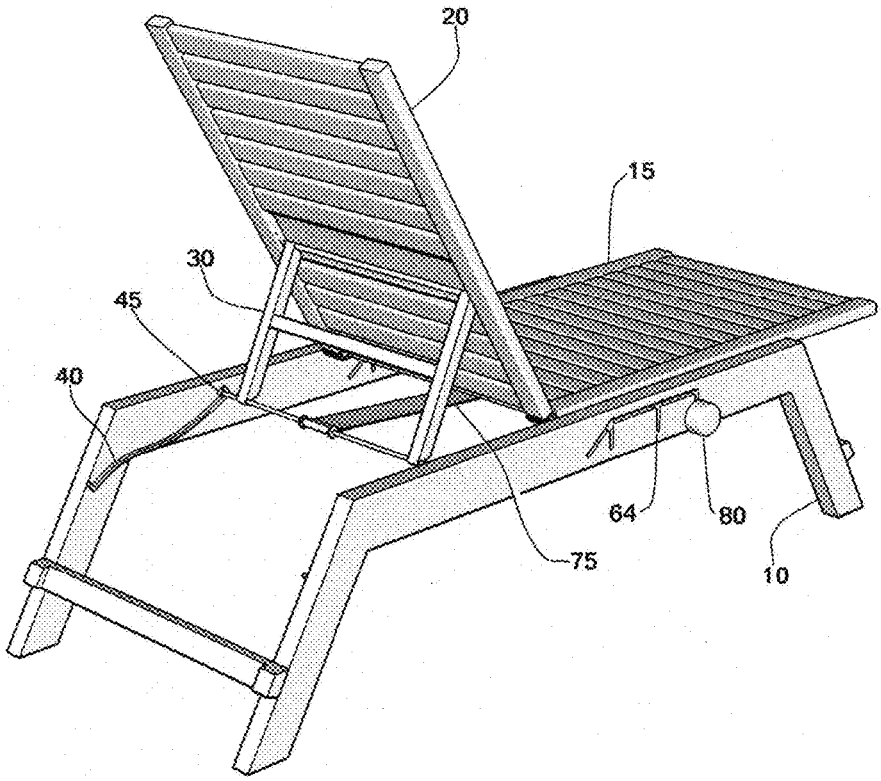

FIG. 10A depicts a perspective chair in upright position, utilizing the positioner of FIG. 10.

Figure 10B:
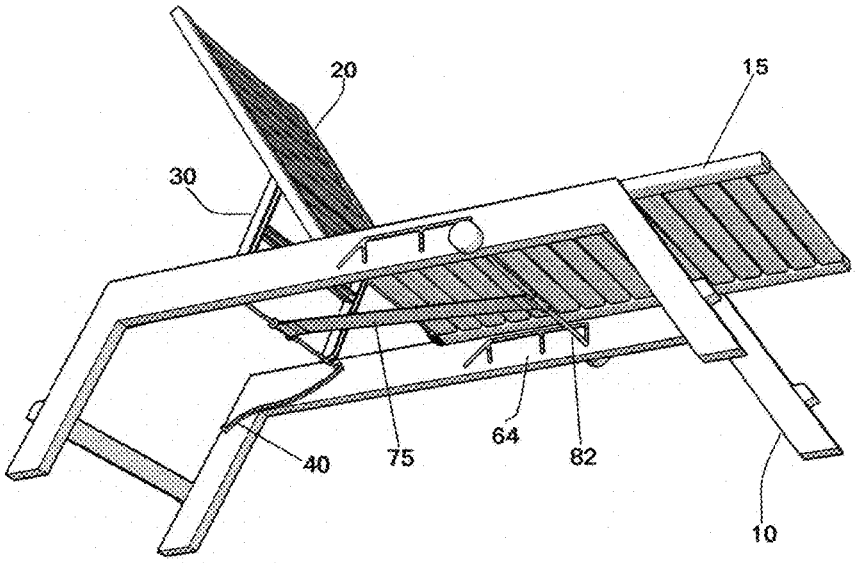

FIG. 10B depicts a bottom perspective of a chair with the positioner of FIG. 10.

Figure 11:
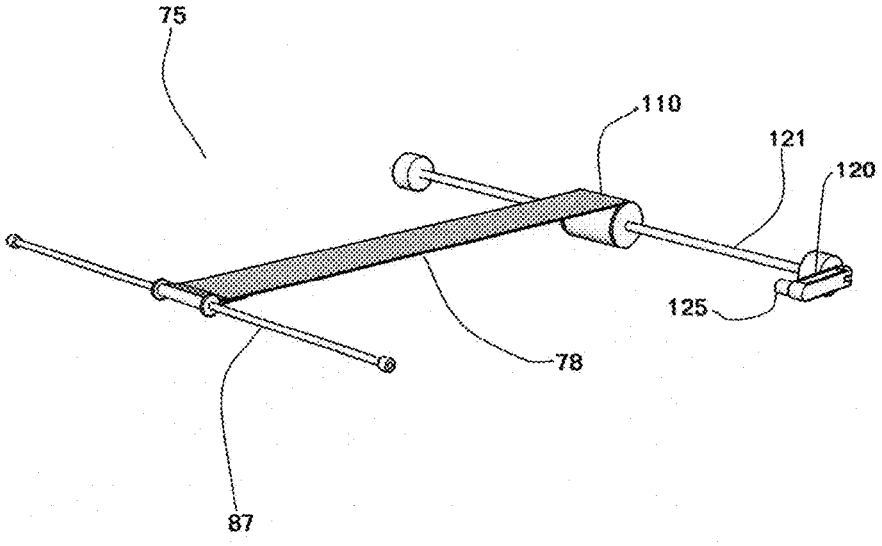

FIG. 11 depict an embodiment of a strap based positioner utilizing a rotary type control actuator.

Figure 11A:
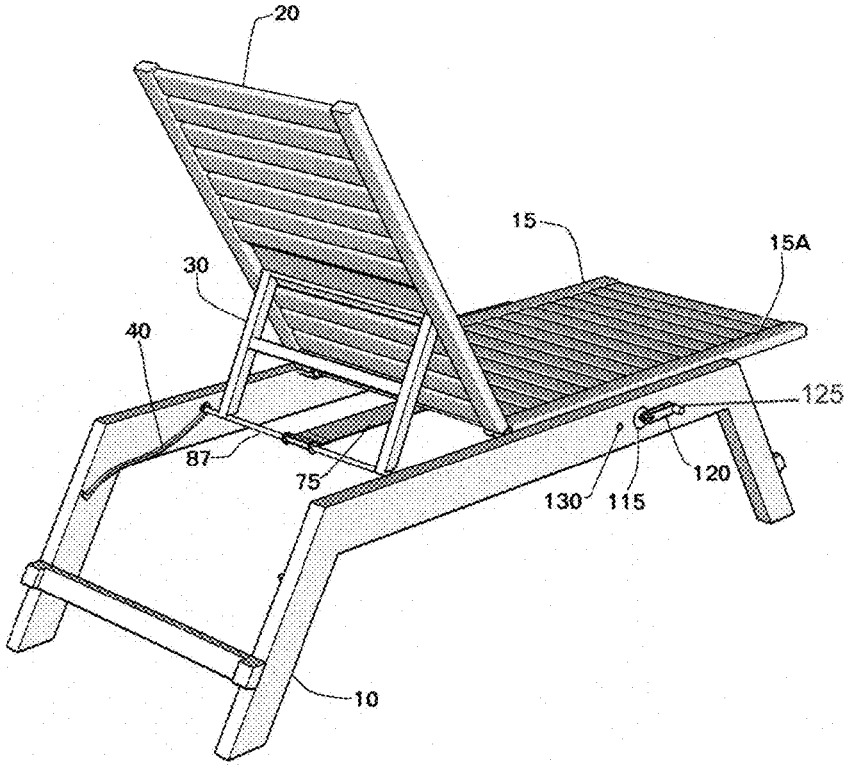
Figure 11B:
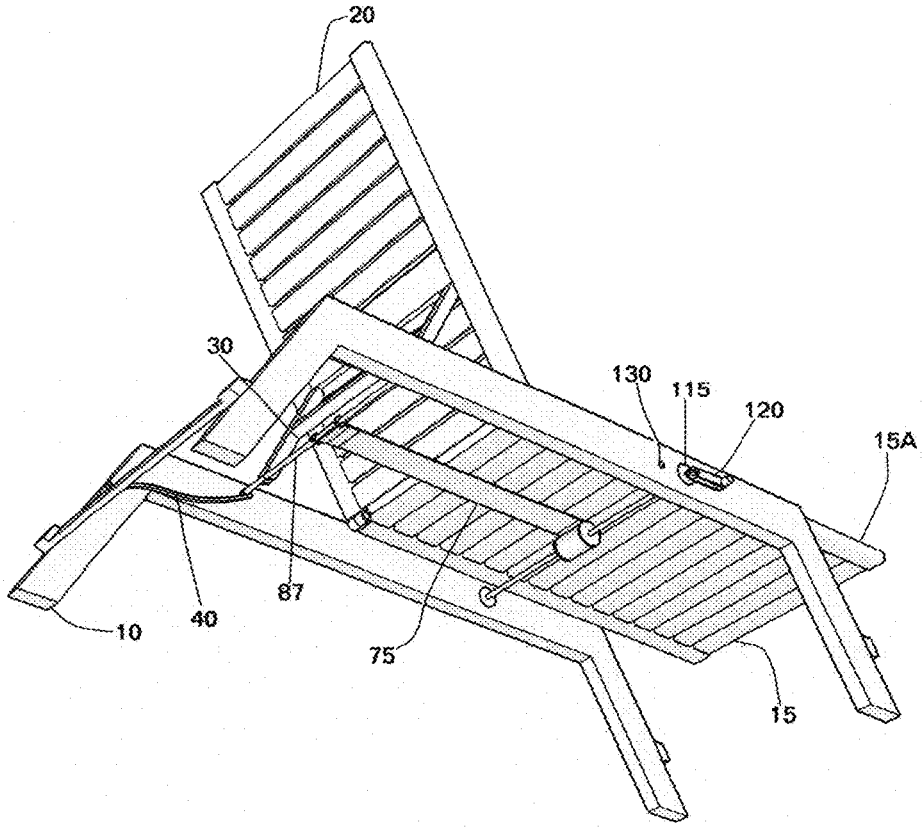

FIGS. 11A and 11B depict respectively a top and bottom perspective views, respectively, of a chair utilizing the rotary type control actuator.

Figure 12:
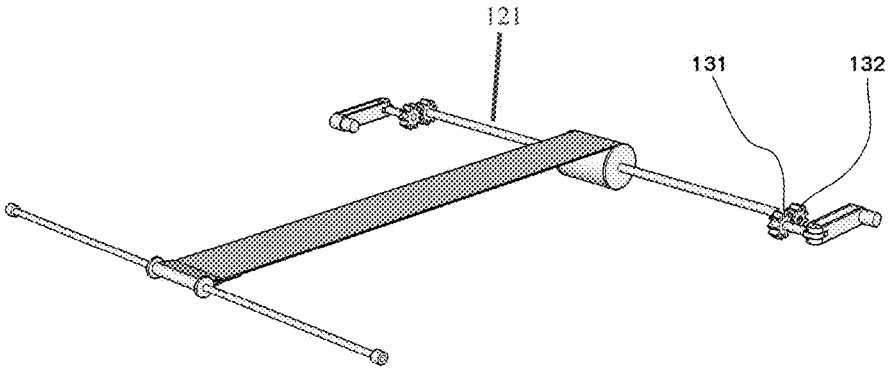
Figure 12A:
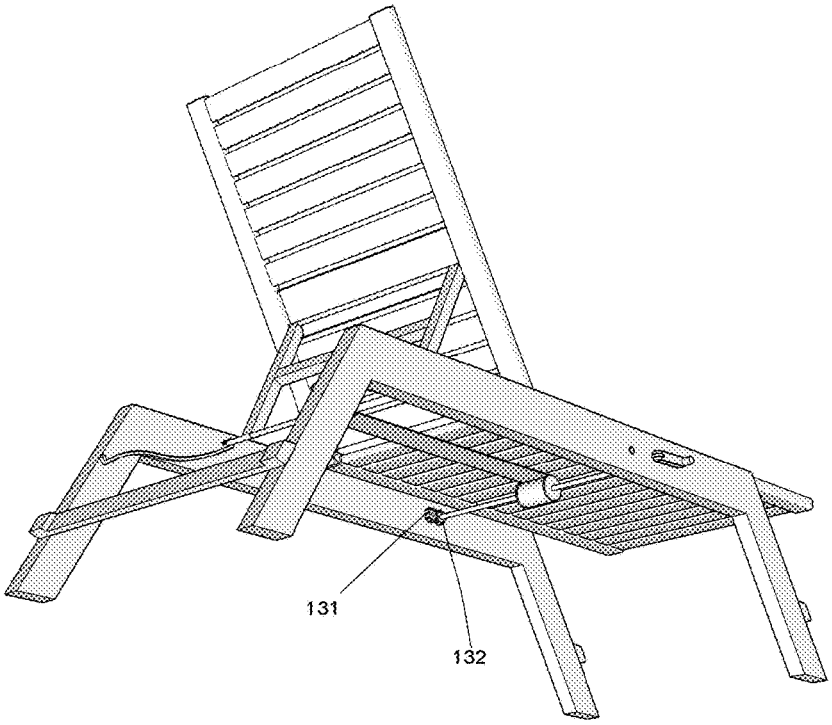

FIG. 12 depicts an optional geared adjustment arrangement while FIG. 12A depicts a bottom perspective view of a chair utilizing the arrangement of FIG. 12.

Figure 13:
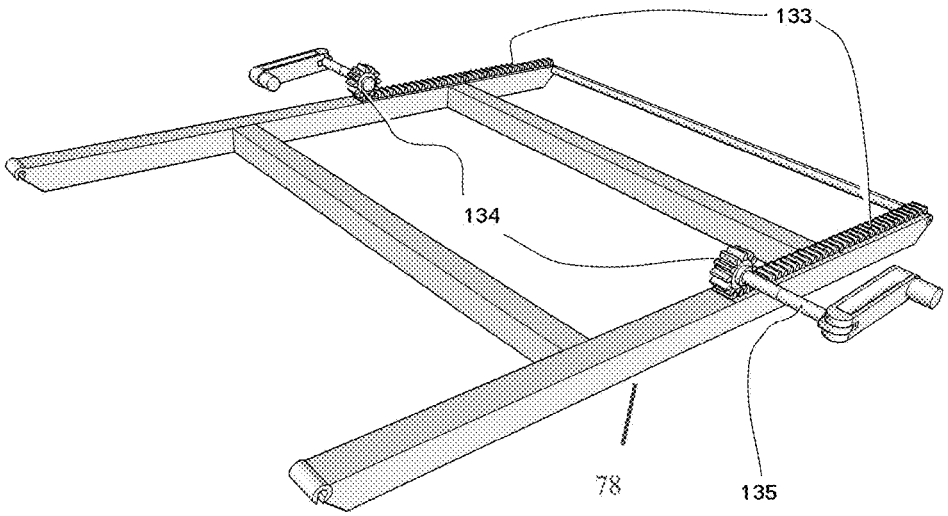
Figure 13A:
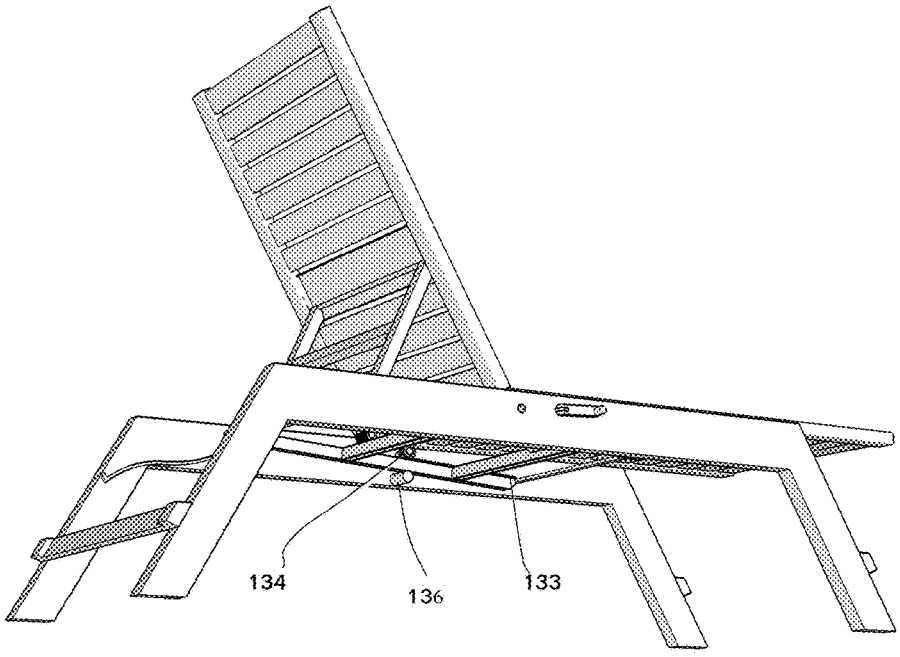

FIG. 13 depicts an optional rack and pinion type adjustment arrangement while FIG. 13A depicts a bottom perspective view of a chair utilizing the arrangement of FIG. 13.

DETAILED DESCRIPTION

In the following detailed description, reference is made to the accompanying drawings which form a part of the disclosure, and in which exemplary implementations are shown by way of illustration, and not of limitation. Further, it should be noted that while the description provides various exemplary implementations, as described below and as illustrated in the drawings, this disclosure is not limited to the implementations described and illustrated herein, but can extend to other implementations, as would be known or as would become known to those skilled in the art. Reference in the specification to "one implementation", "this implementation", "these implementations" or "some implementations" means that a particular feature, structure, or characteristic described in connection with the implementations is included in at least one implementation, and the appearances of these phrases in various places in the specification are not necessarily all referring to the same implementation. Additionally, in the description, numerous specific details are set forth in order to provide a thorough disclosure. However, it will be apparent to one of ordinary skill in the art that these specific details may not all be needed in all implementations. In other circumstances, well-known structures, materials, circuits, processes and interfaces have not been described in detail, and/or may be illustrated in block diagram form, so as to not unnecessarily obscure the disclosure.

Figure 2:
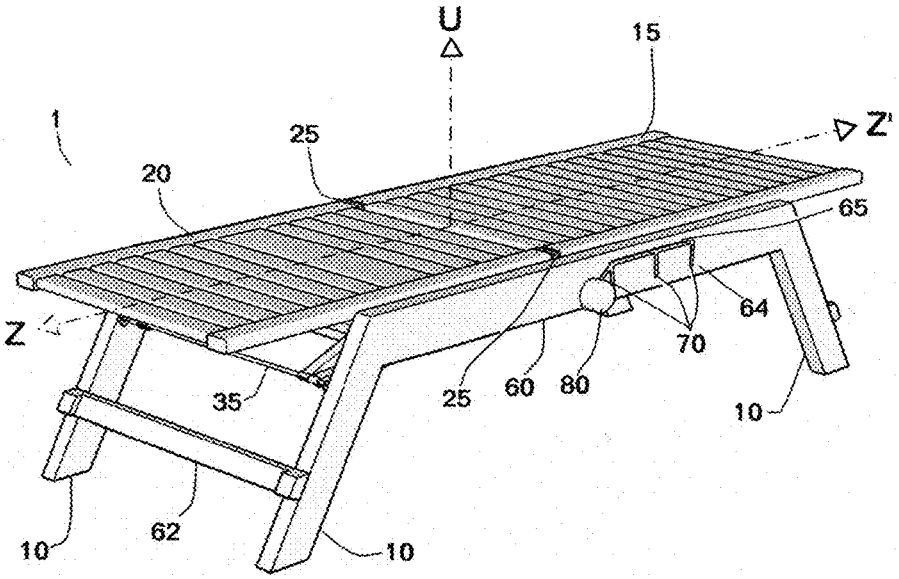
FIG. 2 depicts a perspective view of a chair with the backrest in a flat position.

FIG. 2 depicts a longitudinal axis denoted by axis line Z-Z', and an up direction denoted by arrow U. The arrow pointing to Z' indicates the front portion of the chair. The directional terms 'up', 'down', 'left', 'right' and their conjunctions and inflictions and relations, such as upward, above, lower, below, horizontal, and vertical, are provided for indicating directional orientation relative to the up directions and longitudinal axis, and should be construed at their ordinary and customary meaning, as relevant to the identified direction and axis regardless of the actual orientation of the depicted structure. The term lateral relates to a horizontal direction orthogonal to the longitudinal axis and to the up direction.

Figure 1:
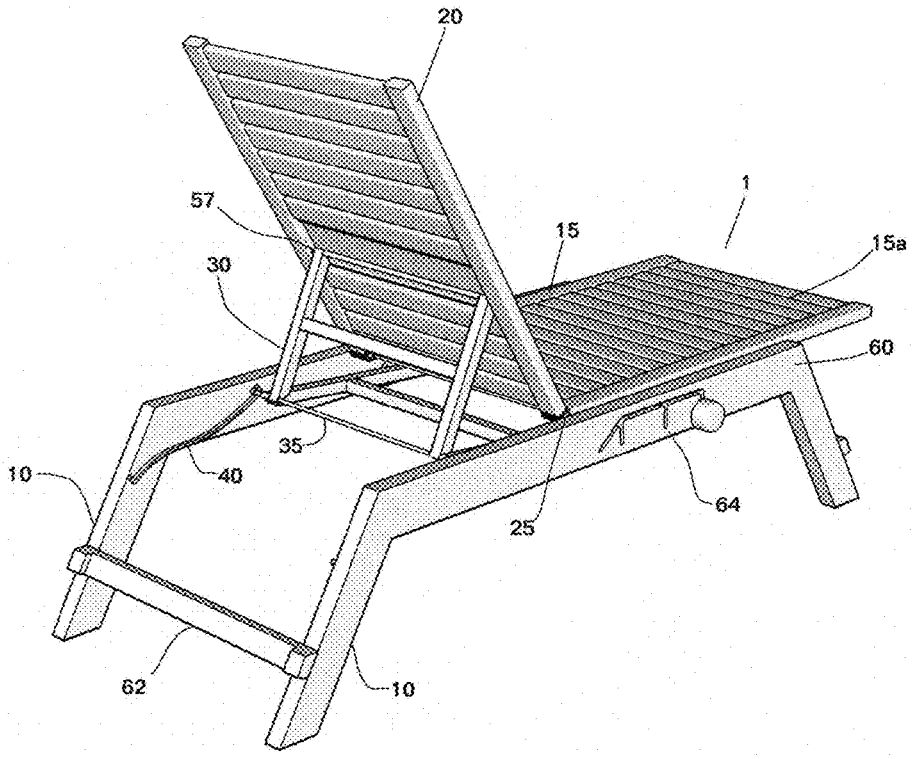
FIG. 1 depicts a perspective view of a chair with a backrest in an upright position.
Figure 2A:
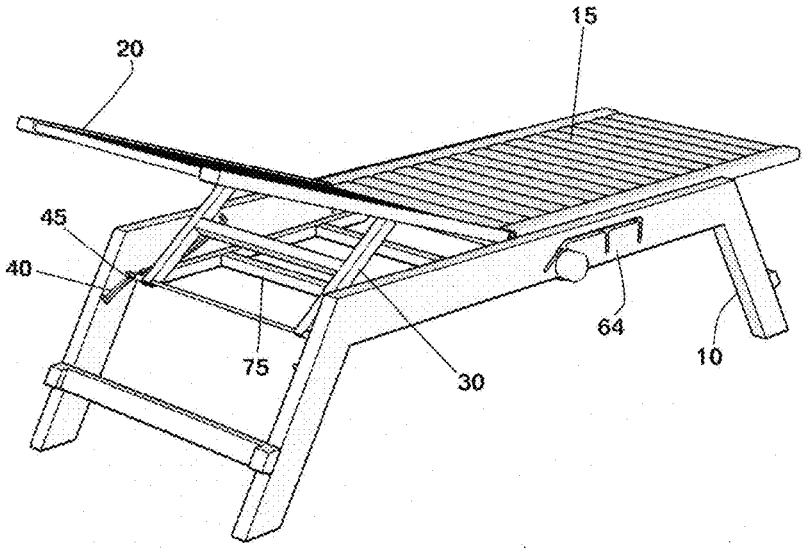
FIG. 2A depicts a perspective view of a chair with the backrest in a partially reclined position.

FIGS. 1, 2, and 2A depict perspective views of an embodiment in accordance with the invention, depicting a chair 1 in an upright position, flat, and inclined positions respectively.

Generally, the chair 1 has a frame depicted in this optional embodiments by two support frame members 10, and a seat 15 extending between the support frame members 10, or coupled thereto via any desired intermediate structure. A hinged backrest 20 is coupled to the chair 1 by any convenient means, such as via the frame (not shown), or via the seat by hinges 25 (as shown). A backrest support 30 is hingedly coupled to the backrest at a point away from the hinge 25. The backrest support 30 is coupled directly or indirectly to track runners 45 which engage elongated support tracks 40 on respective sides of the frame. A positioner 75 is coupled to the backrest support and controls the angle by which the backrest reclines relative to the seat. The positioner is controlled by a control actuator 64 located towards the front or middle of the chair. The control actuator allows setting of the positioner location, which in turn sets the backrest support position. The backrest support 30 and the backrest 20 are coupled to the track runners 45, which are free to move along the support tracks 40. As the backrest support is also coupled to the backrest, moving the positioner sets the position of the backrest.

As the control actuator 64 is located forward of the backrest 20 and at easy reach of a user sitting on the chair, the above described arrangement offers a convenient way by which the user may adjust the backrest position without obliging the user to get up from the chair to affect the backrest adjustment.

The depicted chair has two spaced-apart, generally parallel, support frames 10, each having a front portion, a middle portion, and a rear portion. The frame members further have legs 10A. At least one support track 40 is coupled to the rear portion of each of the support frames 10, and in the depicted embodiments two support tracks are provided, each on its respective support frame members 10. The support track may be molded into the support frame, formed therein, formed as an outer portion thereof, embedded in a slot within the frame member, or otherwise attached to the frame member. The support track 40 extends generally longitudinally and may be straight or curved. Some support tracks are horizontal, and others are inclined. While horizontal support tracks are useful, inclined support tracks offer shorter control movement, and curved tracks allow non-linear backrest position change in response to control inputs, and/or easier detection of preset positions. The support track may be attached to any part of the chair. The portion of the support track which comes into contact with the truck runners is termed a 'slide section' in these specifications, and at least a portion of the slide section is disposed about the rear portion A seat 15 extends laterally between the two support members 10, generally about the mid portion 60 of the frame, however in other embodiments the seat extends forward of the middle of the frame and such configuration will be especially useful in chairs that do not have integral leg support such as a footrest portion, or where the leg support adjustably reclines (not shown). Other seat placements relative to the frame are known and will be clear to the skilled in the art. Thus the placement of the seat portion within the chair is a matter of design choice. The seat 15 is considered to be horizontal or substantially horizontal, regardless of small angular changes from the horizontal plane, which are common. The seat may be contoured and may be made of various configurations and materials. Optionally the seat may have a footrest portion 15A (FIG. 1). The footrest may be integrated with the seat 15, or may be attachable to the chair or the seat, or may be hingedly coupled to the seat or chair such that the foot rest may be rotated to various angles relative to the seat itself. The skilled in the art would readily recognize that the art teaches many ways to attach or couple a footrest to a seat portion, and thus additional embodiments of this optional feature are not shown. In the depicted drawings the seat 15 is shown as having an integrated footrest 15A and for brevity both will be denoted as 'seat' and enumerated 15 hereinafter.

The backrest 20 is pivotable such that its angle relative to the seat may be adjusted. In the depicted embodiments the backrest is hinged to the seat, but other pivoting arrangements such as hinging the backrest to the support frame or to an intermediate structural member are explicitly considered.

The backrest support 30 is hingedly coupled to the backrest 20 and controls the backrest angle relative to the seat. The backrest 30 is coupled directly or indirectly to track runners 45 which engage the support track 40.

A positioner 75 extends forwardly from the backrest support 30 to a control actuator 64. The control actuator 64 controls the position of the positioner, and thereby the backrest support and the backrest in a plurality of selected inclinations. In certain embodiments the positioner is rigid, and in others it is resilient, such as a belt, chain, or strap, by way of example.

Figure 3:
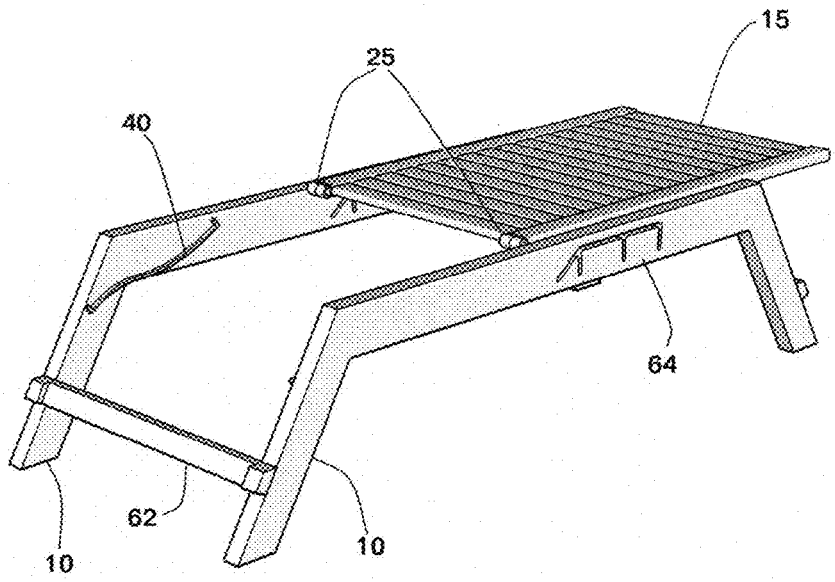
FIG. 3 depicts the chair with the backrest removed.

FIG. 3 depicts the chair of FIGS. 1 and 2 with the backrest and portions of the adjustment mechanism removed for clarity. Hinges 25 are clearly seen on both sides of the seat 15. The frame structure is more clearly visible, showing rear leg portions 10A, optional cross bracing 62, and an embodiment of control actuator 64.

FIGS. 4A, 4B, and 4C depict a simplified schematic cross-section of the rear portion of the chair to facilitate understanding of the principle of operation of the backrest adjustment mechanism of the depicted embodiment. As described above, the backrest 20 may change its angle relative to the seat 15. In this embodiment the adjustment is achieved by moving the positioner 75 or, in certain embodiments, at least the rear portion thereof, longitudinally along the chair. As seen in FIG. 4A, when the positioner 75 extends forwardly, it either directly or indirectly pulls the track runners 45 along the support track 40. The backrest hinge 25, the backrest coupling point 57 to the backrest support, and the track runners 45 define the vertices of a triangle T, shown in heavy lines. As described, motion of the positioner moves the point at which the track runners 45 engage the support track 40. In FIG. 4A the positioner places the track runners 45 on the forward portion of the support track 40 and thus the backrest support 30 is moved forward and urging the backrest upward, close to an upright position. FIG. 4B shows the geometry of triangle T changing, as a result of at least the rear portion of positioner 75 being moved backwards, allowing the track runners 45 to move towards the middle of the support track 40. The triangle side extending between the backrest hinge 25 and the track runners 45, denoted as S2, lengthens relative to S1 shown in FIG. 4A. Therefore, the triangle becomes flatter and the bottom portion of the backrest support 30 is located farther back, and the backrest is reclined at a flatter angle. FIG. 4C depicts yet another configuration, where the positioner is moved farther back placing the track runners 45 farther back on the support track 40, again causing a flatter triangle, and allowing the backrest to recline almost to a flat orientation. The incline range offered by the support track, positioner, backrest hinge and the like is a matter of engineering choice. The specific parts positions shown in FIG. 4 are exaggerated and are provided by way of illustrative explanation rather than as engineering design drawings. Furthermore, for clarity only a portion of the backrest is shown, and the backrest hinges about its bottom surface, to the top surface of the seat. While such hinging options are open to the designer, especially in designs that offer flat configurations, placement of the hinge such that the backrest and seat would form a flat surface is desired, and may be easily achieved by hinging the backrest 20 and seat 15 at similar level, and providing clearance as needed or enabling the desired movement range.

Therefore a principle of the invention involves controlling the position of the backrest by controlling the location of at least one runner along a support track, where the runner is coupled to a backrest support bottom and the backrest is coupled to the backrest by the backrest support upper hinge 57 disposed away from the backrest hinge, such that the backrest hinge, the runner, and backrest support point define the vertices of a triangle. As the position of the backrest hinge 25, and the distance between the backrest hinge and the backrest support upper hinge is fixed, changing the location of the track runner 45 along the support track 40 would change the triangle and therefore change the angle of the backrest relative to the seat.

Specific portions of the depicted example embodiments of the invention would now be described in greater detail, with respect to the figures.

The control actuator 64 is disposed under the seat 15 in a position that is convenient for a user to activate while seated in the chair. In certain embodiments the actuator comprises a substantially horizontal elongated slot 65 in communication with a plurality of detents 70. Optionally two opposed control actuators are disposed in or on the respectively opposed support members. FIG. 5 provides a bottom view of an embodiment of the backrest recline control mechanism from below. The positioner 75 engages the control actuator and extends backwardly therefrom, to engage the backrest support 30. Optionally, the positioner is coupled to one or more handles 80. The elongated slot 65 and the detents 70 are dimensioned to receive a portion of the positioner, such as a portion of control cross rod 82 by way of example, and maintain the control cross rod in any of the detents. It is noted the engagement between the positioner and the control actuator may be implemented in numerous other ways, and such ways will be a matter of engineering choice, and clear to the skilled in the art. By way of non-limiting example, prongs extending outwardly from the positioner may be implemented instead of, or in addition to, the control cross-rod 82. The skilled in the art will identify numerous ways to temporarily affix the positioner 75 in a desired setting, and at least one other example is discussed below.

FIG. 6 depicts a detailed view of the area about the support track and the track runners, in accordance to some embodiments. The area may generally be referred to as the engagement end, which is disposed at the posterior portion of the chair. The term engagement end relates generally to the section of the chair where the backrest 20, backrest support 30, and positioner 75 interact with the support track 40 to set the backrest angle. The track runners 45 slidingly engage their respective support tracks 40 which are built into or otherwise coupled to the frame members 10. The track runners are also coupled to the backrest support 30, either directly or indirectly. The track runners 45 may be directly connected to a portion of the backrest support 30 extending towards the respective support track 40, or alternatively may be coupled to the support track via one or more elements in the engagement portion of the engagement section, such as to the positioner by way of example. The track runners may be embodied as a projection such as a surface or a cylinder, projecting towards the support track, and engaging the support track from above. Optionally the track runner may be embodied in a roller or a rotating bearing. The track runners may also be implemented by two projections or bearings, one dispose to engage the support track from above and the other disposed below the support track. In certain embodiments (not shown) the support track is disposed outside the support frames, and in such cases the track runners are disposed on extenders to engage the support track. In some embodiments the support track, has a top 42 and/or bottom 41 support track stops, to limit the travel of the track runners. In some embodiments the support track 40 may be implemented as a slot in the frame.

It is seen that the track runners 45 are coupled both to the positioner 75 and to the backrest support 30. In the depicted embodiment an optional track cross-rod 35 is attached to the positioner 75 and the backrest support 30 is hinged 55 to the track cross-rod 35. As will be seen below, this is an optional embodiment and the skilled in the art would recognize numerous methods to mutually couple the positioner, the backrest support and the track runners.

Figure 7A:
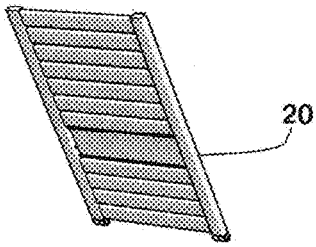
Figure 7B:
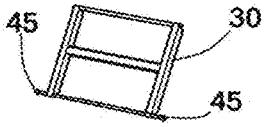
Figure 7C:
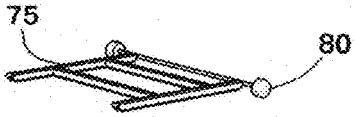
Figure 7D:
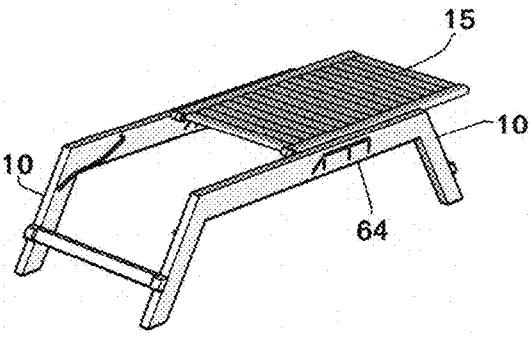
Figure 7E:
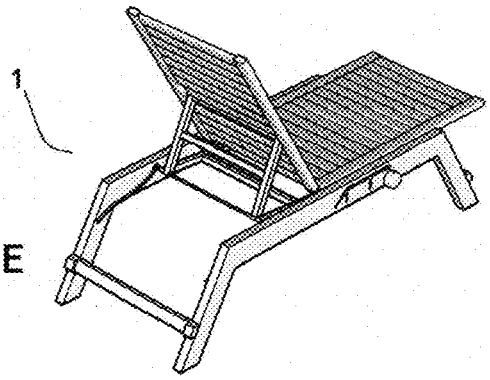

FIGS. 7A-D depict an exploded view of a chair embodiment, showing several individual components, and FIG. 7E depicts the completed chair. FIG. 7A depicts a backrest. FIG. 7B depicts the backrest support, FIG. 7C depicts a positioner, and FIG. 7D depicts the chair frame, the seat, and other structure. Attention is drawn to the fact that in this embodiment, the track runners 45 are coupled to the backrest support 50, as opposed to the arrangement disclosed regarding FIG. 6. In such embodiment the positioner 75 is coupled to the track runners in any desired alternative manner, such as being hinged to the backrest support, to its cross-rod, and the like. This optional embodiment demonstrates but one more example as to the flexibility offered to the designer, without departing from the invention.

FIGS. 8A, 8B, and 8C depict an example arrangement of the backrest support 30 and positioner 75 according to one embodiment. The backrest support 30 is coupled to the backrest 20 at upper hinge point or points 57 (shown elsewhere). It is noted that the hinge points are not necessarily clasping or permanent hinges, but any kind of coupling which provides sufficient support to the backrest and which allows changing the angle between the backrest and the backrest support. In the depicted embodiments an optional track cross-rod 35 is utilized, and the track runners 45 are coupled thereto. However, such construct is optional and the track runners may be coupled elsewhere or in a different manner to the backrest support. It is desired to have a rigid backrest support and to that end, an optional backrest support brace is shown. FIG. 8A depicts the backrest support, FIG. 8B depicts the positioner 75 and FIG. 8C depicts the backrest support and the positioner hingedly engaged.

FIGS. 9A-9C depict an embodiment similar in most detail to FIGS. 8A-8C respectively. However, the truck runners 45 are coupled to a positioner cross-rod 79 which is coupled to the positioner 75 instead of to the backrest support 30. Notably, positioner cross-rod 79 is equivalent in its function to the track control rod 35 which was shown in FIGS. 8A-C to the backrest support. It is seen therefore that significant variations are easily realized from the examples of FIGS. 8A-C and 9A-C that the skilled in the art would be able to provide a large number of variations for coupling the backrest support and the positioner, as well as the location and shape of features such as the track runners, hinges and the like, in view of the present specifications. Similarly, embodiments are foreseen and would be clear to the skilled in the art, where an intermediate member (not shown) may couple the backrest support and the positioner, or the track runners, to the triangular assembly defined by the vertices of the truck runners 45, the backrest hinge 25, and the backrest support to the backrest interface point, denoted as backrest support upper hinge 57.

In previous figures, the positioner 75 had at least one rigid elongated member 78 or a plurality of elongated members which extend between a forward coupling member where the positioner couples to the control actuator 64, to the rear coupling member where the positioner couples to the backrest support 30, to the track runners 45, and thereby to support track 40. Positioner bracing may be provided for rigidity, and such bracing is an optional engineering choice. However, such bracing may be utilized to couple to the backrest support by an intermediate member or members (not shown).

In the depicted embodiments, the forward coupling comprises control cross-rod 82, which is dimensioned to couple to the horizontal slot and the notches of the control actuator 64 shown and described above. The control cross-rod 82 extends between respective control actuators disposed on both sides of the frame. The embodiment of FIG. 8B depicts a positioner having a pair of opposite hinges or holes 85 to receive the cross-rod 35, by which they couple to the track runners 45. However, the skilled in the art would readily recognize that many alternative constructions are available, such as by way of non-limiting example utilizing outwardly extending support prongs from hinges 85 (not shown). The support prongs may couple to track runners 45, and thereby, slidingly couple to the support tracks 40.

It is seen therefore that the skilled in the art would recognize numerous optional forms of coupling the backrest support, the positioner, and the support track or tracks. The guiding principles for designing such coupling are that the movement of the lower portion of the backrest support 30 relative to the support track 40 is limited by the positioner 75, at its various settings.

FIG. 10 depicts yet another example embodiment of a positioner, which is not rigid. The longitudinal member 78 of the positioner 75 of FIG. 10 comprises a strap, such as a belt, a webbing, a rope, a chain, and the like. The strap is coupled at its anterior portion to control cross-rod 82 and to support cross-rod 87 at its posterior portion. Control cross-rod 82 is coupled to the control actuator, and support cross-rod 87 is coupled to the backrest support and is either directly or indirectly coupled to the track runners, in a similar fashion to the control cross-rod 35 and 79 in other embodiments. However, in strap based positioner, as in other positioner types, the support cross-rod is optional and the positioner may couple directly, or by an intermediate member, to the backrest support.

The strap may be flexible or rigid in one or more directions. By way of example a webbing, thin metal, fabric, plastic, chain, or other belt strap would provide longitudinal rigidity, while a rubber strap allows the backrest a range of cushioning movement in response to forces applied thereto via the backrest and the backrest support. Such longitudinally flexible strap would act as a shock absorber and offer the user a range of movement without requiring changes to the control actuator. Alternatively, the strap may be at least partially rigid in both of its longitudinal directions, such as a strap constructed of rigid plastic, thin metal, connected links, and the like, and such strap would enable the control actuator to urge the track runners, backrest support, and backrest backwards towards a flatter disposition. Ropes and other strap types will provide varying physical properties and the selection of strap type is a matter of technical choice, as every type provides certain advantages. If the strap provides rigidity in only one the pull direction, it may only limit the extent to which the track runner 45 slides back on the support tracks 40, but may not push them rearward. Therefore, in embodiments utilizing such straps, gravity, springs, and the like, or even user action, are used to urge the backrest 20 down, and the lower part of the backrest support 30 rearward to the extent permitted by the positioner It is noted that the strap may be coupled to the backrest support 30 and thus FIG. 10A depicts a top rear perspective of a chair utilizing the strap type positioner, while FIG. 10B depicts a bottom perspective thereof, offering clear view of the control mechanism of the chair backrest position.

Various embodiments of control mechanisms are also envisioned. By way of example, FIG. 11 depicts an embodiment of a positioner 75 which uses a rotary control mechanism, and FIG. 11A depicts a top perspective, and FIG. 11B depicts a bottom perspective, of a chair using such rotary control mechanism. As shown, the longitudinal member 78 of the positioner is embodied by a strap, which may be controllably wound over, or released from, roller 110. Roller 110 is coupled to shaft 121, which is rotatable by the user. Notably, the strap may be coupled directly to the shaft 121, and a portion of the shaft 121 over which the strap 78 is spooled acts as the roller 110. An optional crank handle 120 may be provided and coupled to shaft 121, to facilitate rotating thereof. As seen in FIGS. 11A and 11B, a passage 115 is provided to allow coupling of shaft 121 and crank 120. The passage may be a simple hole, a bushing, or a bearing to offer easy rotation of shaft 121. Optionally, passage 115 may be populated by a disk, or a knob. Further optionally, gears (not shown) may be provided to reduce the required effort to turn the crank. In the depicted embodiment the handle is optionally rotatable along an axis transverse to shaft 121, to allow the handle to 'flip' between opposite dispositions. Such opposite dispositions are shown in FIG. 11 and FIG. 11A. FIG. 11A depicts the crank 120 in an 'open' position, where the crank knob 125 points away from the seat, and such position facilitates easy turning of the crank, and thereby of the shaft 121 and roller 110. FIG. 11 depicts the crank handle in the opposite direction, termed 'closed' position, where the crank knob 125 points inward, towards the seat. Optionally a stop, such as cavity 130 is provided in the frame member 10, dimensioned for receiving the crank knob 125 therein. When the crank knob is disposed in the stop, the shaft is prevented from turning, and thus the positioner limits the farthest point the track runners 45 may travel over support tracks 40, and thus limit the position of backrest support 30, which in turn sets the incline angle of the backrest. Notably, the frame member itself, or any other convenient arrangement may be utilized as the stop 130, or other stopping mechanisms may be utilized, as a design choice.

FIG. 12 provides a variation of the positioner 75 depicted in FIG. 11, and FIG. 12A depicts a lower perspective of a chair using such a positioner. In such embodiments a geared coupling, friction coupling, pulley coupling and the like are utilized, primarily to provide mechanical advantage. In the shown embodiment the shaft 121 is has a gear 132 and handle has a gear. The crank handle is coupled to another gear 131 which is in geared communication with the shaft gear 132. The shaft 121 ends are journaled or otherwise supported. More than one gear may be utilized to provide the desired mechanical advantage. The drawing depicts roughly similarly sized gears to show that any ration is acceptable between gears 131 and 132. The skilled in the art would recognize that in order to obtain mechanical advantage the rotator gear 131 is larger than the shaft gear 132.

The drawing depicts an optional second geared rotation mechanisms on the opposite side of the shaft 121. This depiction is provided to show that the mechanism may be at any side, or indeed that two mechanisms may be provided to allow two-handed operation.

Friction based coupling, belt and pulley coupling, and similar coupling mechanisms between the crank handle and the roller are explicitly considered. As their operation is similar, they are not shown.

FIGS. 13 and 13A depict yet another variation of a positioner, using rigid or resilient longitudinal member 78, which utilizes a rack-and-pinion arrangement. In such arrangement a set of teeth 133 is provided on one or two side of the elongated member 78, and a pinion gear 134 which is coupled to a rotating handle via a shaft 135. FIG. 13A depicts a bottom perspective view of a chair utilizing the rack and pinion positioner, and show a retainer 136 for keeping the elongated member 78 in place. Different types of retainers are known in the art, and the retainer depicted in the drawing is merely representative. Similar to the embodiments in FIGS. 12 and 12A the mechanism may be used on any one side of the chair, or on both sides. Shaft 135 may extend to from the handle and provide rotation to the gear on the opposite side of the chair (Not shown). In such embodiments a mechanical advantage may be provided by proper selection of the rack and pinion and gear characteristics, and/or by using a plurality of gears, pulleys, and the like, if a mechanical advantage is desired.

In some embodiments (not shown) the support track is implemented on top of the frame member, or facing outwardly and the track runners are extended by extensions to engage their respective support track. In certain embodiments the support track is embodied away from the frame member 10 and other portions of the support track, such by way of an intermediate structure mounted as a cross-member between the support frames, and/or supported to frame cross member 62. The support track 40 may also be implemented as an elongated slot or groove within the frame.

The seat, backrest and footrest are depicted as slats extending between two side bars, however other structures are explicitly considered, such as padded surfaces, plane surfaces, resilient materials such as fabric and/or netting, contoured slats or surfaces, and the like.

The depicted frame is also a matter of design choice, and different frames and frame mounts are also considered, including by way of non-limiting example a central base acting as legs, a cantilevered frame, a folding frame, and the like. The skilled in the art would also recognize numerous alternative structures for a chair frame support, such as a pedestal, a platform, a cantilevered support and the like. Similarly, the skilled in the art would understand that the frame, seat, and all other parts described herein may be of any appropriate material. While in a preferred embodiment the frame, seat, and backrest are made of plastic material of plastic, those parts, as well as others constituting various aspects of the invention may be made of metal, wood, or any other material which meets the required rigidity, weight and the like, and thus the materials are a m matter of technical choice.

It will be appreciated that the invention is not limited to what has been described hereinabove merely by way of example. While there have been described what are at present considered to be the preferred embodiments of this invention, it will be obvious to those skilled in the art that various other embodiments, changes, and modifications may be made therein without departing from the spirit or scope of this invention and that it is, therefore, aimed to cover all such changes and modifications as fall within the true spirit and scope of the invention, for which letters patent is applied.

I claim:

1. An adjustable chair comprising:

a pair of substantially parallel support frames disposed at a distance therebetween, the support frames having a rear portion, mid-portion, and a front portion;

a seat disposed between the support frames;

a backrest pivotable relative to the seat, the backrest is disposed rearwardly of the seat and pivotable at least partially over the rear portion;

a control actuator coupled directly or indirectly to the seat or to at least one of the support frames, and disposed forward of the point at which the backrest hinges relative to the seat;

at least one longitudinally extending support track coupled to the seat and having a slide section disposed at least partially about the rear portion;

at least one track runner slideable over or in the support track, the at least one track runner being directly or indirectly coupled to a backrest support having an upper portion hingedly coupled to the backrest; and, a positioner having an engagement end coupled to the at least one track runner, and a longitudinally opposing control end, the control end being coupled to the control actuator, such that the engagement end is constructed to limit the extent of rearward movement of at least one track runner about the support track.

2. A chair as claimed in claim 1 further comprising a leg support section coupled to the chair forwardly of the seat.

3. A chair as claimed in claim 1, wherein the control actuator comprises a horizontally extending slot having a plurality of notches dimensioned to receive a portion of the control end of the positioner, or a part coupled thereto.

4. A chair as claimed in claim 1, wherein the positioner comprises a belt or a strap, or a combination thereof.

5. A chair as claimed in claim 4, wherein the control actuator comprises a rotator coupled to a rotating body for applying rotation thereto, and wherein a control end of the strap or belt is coupled to the rotating body, for being spooled thereby.

6. A chair as claimed in claim 5, wherein the rotator is coupled to the rotating body by at least one of a direct coupling, a geared coupling, a friction coupling, a screw coupling, a pulley coupling, a rack-and-pinion coupling, or any combination thereof.

7. A chair as claimed in claim 5, wherein the rotator comprises at least one of a shaft, a knob, a gear, an electric or hydraulic motor, a wheel, or a combination thereof.

8. A chair as claimed in claim 5 wherein the rotator comprises a shaft rotatable by a handle, and a stop for preventing the handle from turning.

9. A chair as claimed in claim 5, wherein the actuator further comprises at least one of a gear, a screw, a friction mechanism, a rack-and-pinion, a chain, a belt, a shaft, and any combination thereof, disposed intermediately between the rotator and the rotating body for coupling between the rotator and the rotating body.

10. A chair as claimed in claim 3, wherein the positioner comprises at least one rigid longitudinal member.

11. A chair as claimed in claim 10 wherein the control actuator comprises a pinion and wherein the positioner comprises a rack forming a rack and pinion coupling therebetween.

12. An adjustable chair comprising:

a pair of substantially parallel support frames disposed at a distance between the support frames having a rear portion, mid-portion, and a front portion;

a seat disposed between the support frames mid portion;

a backrest pivotable relative to the seat, the backrest being disposed rearward to the seat and at least partially over the rear portion;

a control actuator disposed about the mid portion or the front portion;

each of the support frames having a longitudinally extending support track disposed at least partially about the rear portion;

at least two track runners each sliding over a respective support track;

a backrest support having an upper portion hingedly coupled to the backrest, and a lower portion, each side of the lower portion being coupled to the respective one of at least two track runners;

a rigid positioner having an engagement end coupled to the track runners, and a longitudinally opposing control end, the control end being coupled to the control actuator, such that the engagement end is constructed to limit the extent of rearward movement of the track runner about the support track.

13. An adjustable chair as claimed in claim 12, wherein the control actuator comprises a horizontally extending slot having a plurality of notches dimensioned to receive a portion of the control end of the positioner, or a part coupled thereto.

14. An adjustable chair comprising:

a pair of substantially parallel support frames disposed at a distance between the support frames having a rear portion, mid-portion, and a front portion;

a seat disposed between the support frames mid portion;

a backrest pivotable relative to the seat, the backrest being disposed rearward to the seat and at least partially over the rear portion;

each of the support frames having a longitudinally extending support track disposed at least partially about the rear portion;

at least two track runners each sliding over a respective support track;

a backrest support having an upper portion hingedly coupled to the backrest, and a lower portion, each side of the lower portion being coupled to the respective one of at least two track runners;

a control actuator disposed about the mid portion or the front portion, the control actuator comprising a rotator coupled to a rotating body;

a resilient positioner having an engagement end coupled to the track runners, and a longitudinally opposing control end, the control end being coupled to the rotating body and spooled thereabout, such that the positioner is constructed to limit the extent of rearward movement of the track runner about the support track, in accordance with the portion of the positioner that is spooled on the rotating body.

15. A chair as claimed in claim 14, wherein the rotator is coupled to the rotating body by at least one of a direct coupling, a geared coupling, a friction coupling, a screw coupling, a pulley coupling, or any combination thereof.

16. A chair as claimed in claim 15, wherein the rotator comprises at least one of a shaft, a knob, a gear, an electric or hydraulic motor, a wheel, a ratcheted arrangement, or a combination thereof.

17. A chair as claimed in claim 14 wherein the rotator comprises a shaft rotatable by a handle, and a stop for preventing the handle from turning.

18. A chair as claimed in claim 14, wherein the actuator further comprises at least one of a gear, a screw, a friction mechanism, a rack-and-pinion, a chain, a belt, a shaft, and any combination thereof, disposed intermediately between the rotator and the rotating body for coupling between the rotator and the rotating body.

* * * * *